United States Patent [19]

Fardeau

[11] Patent Number: 4,617,910

[45] Date of Patent: Oct. 21, 1986

[54] APPARATUS AND METHOD FOR PRODUCING AND STORING HEATED LIQUID

[75] Inventor: Benoît Fardeau, Pierrefitte, France

[73] Assignee: GAZ de France, France

[21] Appl. No.: 719,804

[22] Filed: Apr. 4, 1985

[30] Foreign Application Priority Data

Apr. 5, 1984 [FR] France ..... 8405394

[51] Int. Cl.[4] ..... F24H 1/00

[52] U.S. Cl. ..... 126/362; 126/360 R

[58] Field of Search ..... 126/360 R, 362, 367, 126/368, 437; 219/297, 314; 122/28; 165/159

[56] References Cited

U.S. PATENT DOCUMENTS

| | | | |
|---|---|---|---|
| Re. 21,393 | 3/1940 | Losee | 219/314 |
| 851,887 | 4/1907 | Ingold | 126/368 |
| 995,219 | 6/1911 | Bradley | 126/437 X |
| 3,105,137 | 9/1963 | Sullivan et al. | 219/40 |
| 3,356,135 | 12/1967 | Sayre | 165/159 |

FOREIGN PATENT DOCUMENTS

| | | | |
|---|---|---|---|
| 625026 | 1/1936 | Fed. Rep. of Germany . | |
| 1297953 | 6/1969 | Fed. Rep. of Germany . | |
| 2641601 | 3/1978 | Fed. Rep. of Germany | 219/297 |
| 1081318 | 12/1954 | France | 126/360 R |
| 46-29416 | 8/1971 | Japan | 126/360 R |
| 158742 | 12/1979 | Japan | 126/360 R |
| 670664 | 4/1952 | United Kingdom . | |

*Primary Examiner*—James C. Yeung
*Assistant Examiner*—Allen J. Flanigan
*Attorney, Agent, or Firm*—Steinberg & Raskin

[57] ABSTRACT

Apparatus and method for producing and storing heated liquid such as hot water, with immersed heating of the liquid. A tank of relatively small volume for heating the liquid to the temperature required for use, having a heating body at least partially immersed therein, and a second tank of larger volume communicating with the first tank, preferably by an overflow, are provided. The second tank serves as a reservoir for hot liquid produced in the first tank, the liquid level within the second tank varying, in accordance with desired use. The present invention may be applied for producing heated liquid, e.g. hot water, for both domestic and industrial use.

11 Claims, 1 Drawing Figure

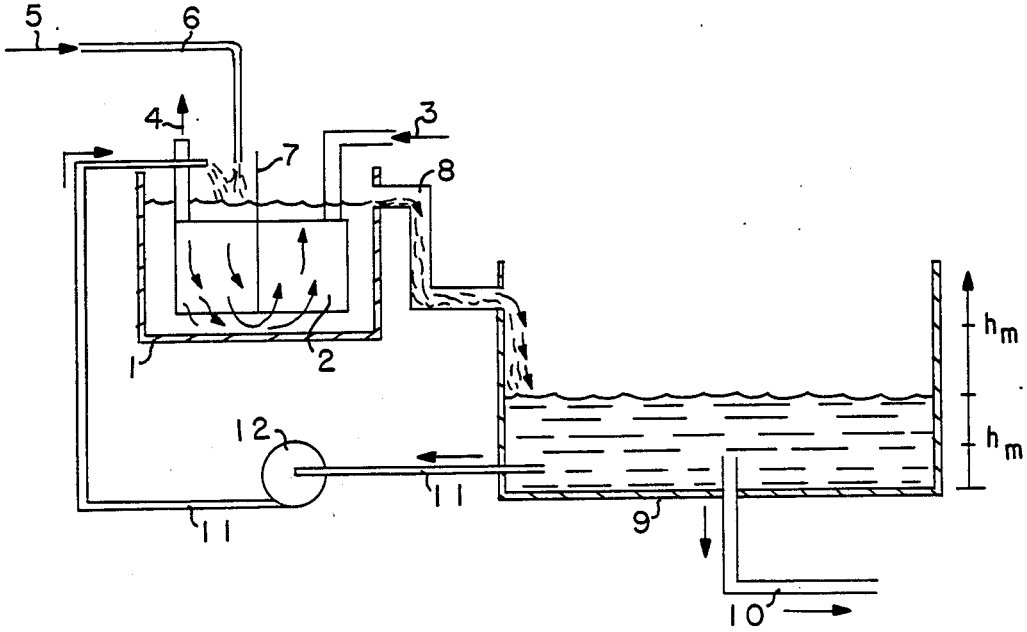
5
6
4
3
7
8
1
2
12
11
11
9
10
$h_m$
$h_m$

APPARATUS AND METHOD FOR PRODUCING AND STORING HEATED LIQUID

BACKGROUND OF THE INVENTION

The present invention relates to an apparatus for producing and storing heated liquid such as hot water. The present invention is also directed to a method of heating a liquid such as water, and storing the same.

Since liquid such as water has a high thermal capacity, production of large quantities of heated liquid such as water requires a large supply of thermal energy.

Apparatus or installations designed for supply of heated liquids such as hot water, are frequently required to cope with demand for a virtually instantaneous supply of very large quantities of heated liquid such as water, which may be followed by extremely long periods during which the demand for heated liquid is practically non-existent. This is especially true for installations or plants that supply domestic hot water in residential buildings, as well as for various installations that produce heated water for industrial purposes.

Previous solutions that have been proposed in the prior art are essentially of two types.

The first type is directed to an installation that is equipped with a heating body having excess capacity that is capable of instantaneously meeting any demand for hot water. This results in excessive overall costs for such an installation, as well as resulting in low combustion yields when the installation is operated at much below its nominal capacity.

A second type of solution involves an installation or plant using a heating body having a nominal capacity substantially corresponding to the average output per unit time (for example 24 hours) normally required for such an installation. This generator is enclosed in a large reservoir, enabling any demand to be supplied instantaneously, essentially by making use of the stratification of hot and cold layers within the reservoir, the hot layers being at the top and the cold layers being underneath. The disadvantage of this type of installation is that it lacks flexibility, particularly with regard to the design of the heating generator inside a storage reservoir of large capacity, and with regard to installing such an apparatus in position.

SUMMARY OF THE INVENTION

Accordingly, it is an object of the present invention to provide new and improved apparatus and method for heating a liquid and for storing the same.

It is also an object of the present invention to eliminate the above-noted disadvantages with respect to the prior art.

It is another object of the present invention to improve the ease of manufacture and installation of a unit for providing heated liquid at desired times.

It is a further object of the present invention to minimize costs involved in operating an apparatus for supplying heated liquid.

It is even another object of the present invention to provide for safe, effective, reliable supply of heated liquid for use.

It is even a further object of the present invention to facilitate provision of heated liquid for use at any convenient time, even if instantaneously required, and to provide for convenient storage of the heated liquid when not required.

These and other objects are attained by the present invention, which provides an apparatus for heating a liquid, such as water, which comprises a first tank for receiving the liquid, and heating means disposed within the first tank for heating the liquid contained therewithin, the heating means being at least partially immersed in the liquid within the first tank. Inlet means for introducing the liquid to be heated into the first tank is also provided. Additionally, a second tank of larger volume than the first tank and communicating with the same is provided, the second tank serving as a reservoir for the liquid that is heated within the first tank. Outlet means for removing heated liquid from the second tank is provided too. Means for varying the level of the liquid within the second tank, and conveying means for conveying the heated liquid from the first tank to the second tank, may also be provided.

Thus, according to the present invention, an apparatus for production of heated liquid of the type having an immersed heater within the liquid, includes a smaller tank for raising the temperature of the heated liquid, this tank containing an immersed heating body within the liquid therewithin, and also includes a larger tank for storing the thus-heated liquid that is supplied from the first tank, the second tank having a varying liquid level. At least one inlet opening into the first tank, for liquid to be heated such as cold water is provided, while at least one outlet for heated liquid from the second tank, such as hot water, is provided too. The first tank advantageously communicates with the second tank by an overflow, with means for recirculating heated liquid from the second tank back to the first tank also being provided. The recirculating means returns a smaller quantity of liquid from the second tank to the first tank, than is supplied from the first tank to the second tank to begin with.

According to the present invention, the first tank with its integrated heating body can be constructed under the optimum conditions for operation, output efficiency, and overall installation of the unit itself. Provision of the second tank, having a volume that is virtually independent from the volume or capacity of the first tank, enables the volume of heated liquid to be stored to be precisely adapted to requirements. The design and construction of the second tank are especially simple, since this tank basically serves as a storage reservoir.

The fact that the first tank communicates with the second tank by an overflow, ensures that the heating body within the first tank will always remain at least partially, preferably totally immersed within the liquid therewithin, which is an essential requirement for safe and reliable operation of the heating body itself.

The preferable recirculation of liquid from the second tank back to the first tank, at a rate lower than supply of the liquid from the first tank to the second, prevents any drop in temperature of the liquid stored within the second tank, if such liquid remains unused within the second tank for a particularly long period of time. The variable level of heated liquid stored within the second tank, enables any demand for such heated liquid to be instantaneously met, even a demand for a large quantity of hot water, since the storage tank can be refilled when the demand for hot water is low, i.e. when little or no heated liquid is required for use.

The present invention is also directed to a method for heating a liquid and for storing the same, which involves conveying the liquid to be heated into a first tank up to a level at least partially immersing heating means within the first tank, along with heating a liquid therewithin, and followed by conveying the heated liquid from the first tank to a second tank that serves as a reservoir for the heated liquid itself. The heated liquid may be conveyed or supplied to the second tank from the first tank by overflowing from the first tank, while part of the liquid within the second tank is preferably recirculated back to the first tank.

BRIEF DESCRIPTION OF THE DRAWING

The present invention will be described in greater detail below, with reference to the accompanying drawing, which is a schematic illustration of the apparatus and method of the present invention.

DETAILED DESCRIPTION OF THE PREFERRED EMBODIMENT

Referring to the figure, a first tank 1 of relatively small volume is illustrated, in which a heating body 2 is immersed within the liquuid to be heated. This heating body 2 may be, for example, a heat generator operating on a mixture of fuel gas and air supplied through conduit 3. The combustion products exit from the heating body 2 through conduit 4. These products of combustion, or "fumes", preferably pass through the first tank 1, towards the side of the tank where the liquid to be heated, e.g. cold water, is introduced into the apparatus of the present invention, through conduit 6 as indicated by arrow 5. The first tank 1 may be provided, for example, with one or more partitions such as indicated at 7, to enable the liquid which is to be heated to circulate through the first tank 1, in a countercurrent direction with respect to direction of flow of the combustion gas through the heating body 2.

The liquid that has been heated in the first tank 1, e.g. the hot water, advantageously exits from the opposite side of the tank 1, through the overflow conduit 8 which empties into a storage tank 9 of larger volume or capacity than the first tank 1. This second tank 9 essentially contstitutes a buffering reservoir, with the level of heated liquid, e.g. hot water, within this second tank 9 varying according to demand, e.g. between a minimum height $h_m$ and a maximum height $h_M$. When hot water is required, it is withdrawn from the second tank 9 through a conduit 10. The second tank 9 may have a bottom situated lower than a bottom of the first tank 1, as illustrated.

To prevent the water stored within the tank 9 from cooling during prolonged periods of storage, recirculation of the liquid or water from the second tank 9 back to the first tank 1 at a reduced rate, i.e. at a lower rate than the liquid being supplied through the overflow conduit 8, is advantageously provided. The liquid or water may be recirculated from the second tank 9 back to the first tank 1 through a recycle conduit 11, by means of a recirculating pump 12. The recirculating pump 12 may be controlled by thermostatic means situated within the second tank 9, which activates the pump 12 when the temperature of liquid stored within the second tank 9 should happen to fall below a predetermined value. In other words, the recirculating means for recirculating the liquid from the second tank 9 back to the first tank 1 of the present invention, may include sensing means for sensing temperature of the liquid within the second tank 9, and controlling means for controlling the pump 12 in response to the temperature of the liquid that is sensed within the second tank 9.

Conventional control means for preventing the entry of cold water through conduit 6 along arrow 5 when the second tank 9 is full, and also preferably for preventing any withdrawal of heated liquid from the second tank 9 when the level within this second tank 9 falls below a predetermined minimum value, may also be provided in accordance with the present invention.

Numerous variations, alternatives, or modifications of the above-described embodiment may be practiced in accordance with the spirit of the present invention. For example, the first heating tank 1 may be arranged at least partially within the second storage tank 9. Furthermore, volumetric capacity of the second storage tank 9 may be optimized according to the peak demand, duration of such demand, and frequency of such peak demand.

Accordingly, the preceding description of the present invention is merely exemplary, and is not intended to limit the scope thereof in any way.

What is claimed is:

1. Apparatus for heating a liquid, comprising a first tank for receiving the liquid to be heated, heating means for heating the liquid in said first tank, said heating means situated within said first tank to be at least partially immersed in the liquid to be heated therewithin, inlet means for introducing liquid from an external source into said first tank, a second tank of larger volume than said first tank and communicating with the same, said second tank serving as a reservoir for the liquid heated in said first tank, outlet means located near the bottom of said second tank for removing the heated liquid from the same, and means for varying the level of the liquid within said second tank comprising recirculating means for recirculating liquid from said second tank to said first tank;

whereby hot liquid at a substantially uniform temperature can be substantially instantaneously supplied.

2. The combination of claim 1, additionally comprising conveying means for conveying heated liquid from said first tank to said second tank, which comprise overflow means for overflowing liquid from said first tank to said second tank, said overflowing means communicating with both said tanks.

3. The combination of claim 1, wherein said recirculating means comprise pump means for pumping liquid from said second tank back to said first tank, sensing means for sensing temperature of the liquid within said second tank, and controlling means for controlling said pump means in response to the sensed temperature of the liquid within said second tank.

4. The combination of claim 2, additionally comprising circulation means for circulating liquid through said first tank; and means for passing a heating medium through said heating means at leas partially immersed in the liquid within said first tank, in a substantially counter-current direction to the circulation direction of the liquid through said first tank.

5. The combination of claim 4, wherein said circulation means comprise at least one partition disposed in said first tank for directing flow of the liquid therearound.

6. The combination of claim 4, additionally comprising preventing means for preventing introduction of liquid to be heated into said first tank when the level of the liquid in said second tank rises above a predetermined maximum level, and for preventing withdrawal of heated liquid from said second tank when the level of liquid within said second tank falls below a predetermined minimum level.

7. The combination of claim 2, wherein the bottom of said second tank is situated at a level below a level at which a bottom of said first tank is situated.

8. Method for heating a liquid and storing the same, comprising the steps of conveying the liquid to be heated into a first tank up to a level at least partially immersing heating means within the first tank, heating the liquid within the first tank by the heating means at least partially immersed in the liquid, conveying by overflowing the heated liquid from the first tank to a second tank of larger volume than said first tank serving as a reservoir for the heated liquid, recirculating the heated liquid from said second tank to said first tank as required to maintain said heated liquid in said second tank at a desired temperature, removing the heated liquid from the vicinity of a bottom of the second tank, when required, introducing liquid from an external source into said first tank to replace the removed heated liquid as required, and varying the level of liquid within said second tank, whereby hot liquid at a substantially uniform temperature can be substantially instantaneously supplied.

9. The method of claim 8, wherein recirculating of the liquid from the second tank back to the first tank comprises the steps of pumping the liquid from the second tank back to the first tank, sensing temperature of the liquid within the second tank, and controlling the rate of pumping of the recirculated liquid based upon the temperature of the liquid sensed within the second tank.

10. The method of claim 8, comprising the additional steps of circulating liquid through the first tank, and passing heating medium through the heating means at least partially immersed in the liquid within the first tank, in a substantially counter-current direction to the circulation direction of the liquid through the first tank.

11. The method of claim 10, comprising the additional steps of preventing introduction of liquid into the first tank when the level of liquid in the second tank rises above a predetermined maximum level, and preventing withdrawal of liquid from the second tank when the level of liquid within the second tank drops below a predetermined minimum level.

* * * * *